United States Patent [19]

Sander et al.

[11] 4,224,259

[45] Sep. 23, 1980

[54] MANUFACTURE OF FIBRIDS FROM POLYMERS

[75] Inventors: Bruno Sander, Ludwigshafen; Eckhard Bonitz, Frankenthal; Kurt Scherling, Hemsbach, all of Fed. Rep. of Germany

[73] Assignee: BASF Aktiengesellschaft, Fed. Rep. of Germany

[21] Appl. No.: 944,644

[22] Filed: Sep. 18, 1978

Related U.S. Application Data

[63] Continuation of Ser. No. 674,149, Apr. 6, 1976, abandoned.

[30] Foreign Application Priority Data

Apr. 16, 1975 [DE] Fed. Rep. of Germany ..... 2516561

[51] Int. Cl.[3] ..... B29C 6/00

[52] U.S. Cl. ..... 264/11; 162/157 R; 264/140

[58] Field of Search ..... 264/204, 13–14, 264/140; 162/157 R

[56] References Cited

U.S. PATENT DOCUMENTS

| | | | |
|---|---|---|---|
| 2,999,788 | 9/1961 | Morgan | 162/157 R |
| 3,529,936 | 9/1970 | Muller-Rid et al. | 264/14 |
| 3,661,864 | 5/1972 | Tapp et al. | 260/78 S |
| 3,920,507 | 11/1975 | Yonemori et al. | 162/157 R |
| 4,001,157 | 1/1977 | Sander et al. | 260/17 R |
| 4,013,751 | 3/1977 | Davis et al. | 264/140 |
| 4,091,058 | 5/1978 | Sander et al. | 264/14 |
| 4,104,341 | 8/1978 | Keppler et al. | 264/140 |
| 4,110,385 | 8/1978 | Sander et al. | 264/140 |

FOREIGN PATENT DOCUMENTS

| | | | |
|---|---|---|---|
| 47-45604 | 11/1972 | Japan | 162/157 R |
| 49-41127 | 11/1974 | Japan | 264/13 |

*Primary Examiner*—Jay H. Woo
*Attorney, Agent, or Firm*—Keil & Witherspoon

[57] ABSTRACT

Fibrids of polymers of styrene, which are obtained in a fluid precipitation medium under the action of shearing forces.

3 Claims, 2 Drawing Figures

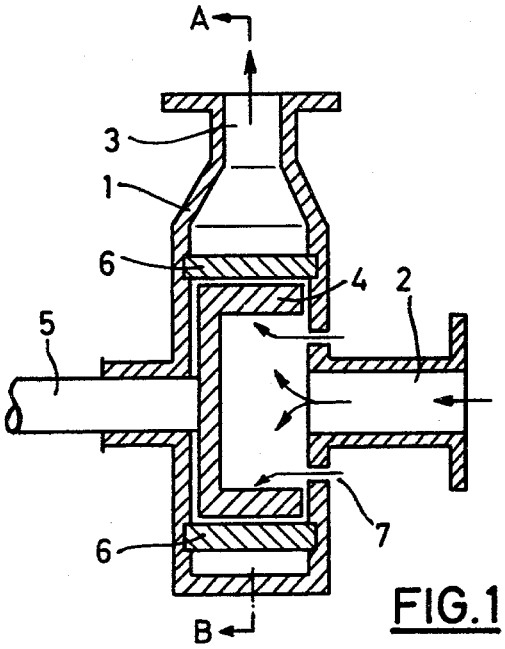
FIG.1
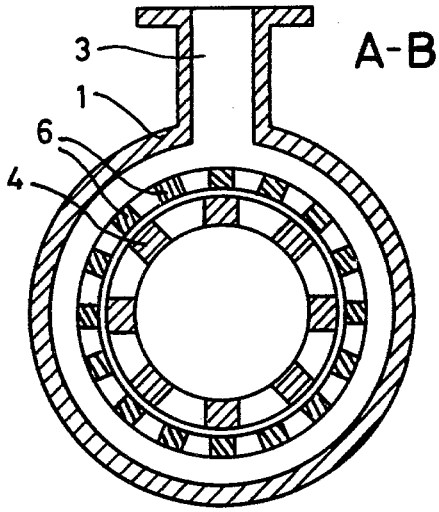

MANUFACTURE OF FIBRIDS FROM POLYMERS

This application is a continuation of application Ser. No. 674,149, filed Apr. 6, 1976, now abandoned.

The present invention relates to a process for the manufacture of fibrids by introducing the solution of a polymer which is amorphous, or only slightly crystalline, into a fluid precipitation medium in a field of shearing forces.

German Printed Application 1,469,120 discloses a process whereby suspensions of fibrids are obtained when polymers are precipitated from a solution by dispersing the solution in a precipitation medium under the action of shearing forces. The shearing action is produced either by a stirrer (Waring mixer) or by a fluid undergoing turbulent flow.

Further, German Laid-Open Application 2,252,758 discloses a process for producing fibrids from polymers of high molecular weight. However, in this process it is necessary to feed a hot solution of the polymer to a rapidly rotating centrifugal spinning apparatus (hammer mill). In the process described, the polymer solution undergoes orientation in a first process step, and in a second step the dissolved polymer is precipitated. However, the product obtained only consists of a fibrous mass swollen with solvent, from which mass the individual fibrids still have to be liberated. This is done in a series of subsequent, expensive processes, such as expressing the solvent, chopping the fibrous mass and carrying out several milling processes.

It is an object of the present invention to convert amorphous or only slightly crystalline polymers into high-quality fibrids in a single process step, at room temperature.

We have found that this object is achieved when solutions of polymers or copolymers of styrene, vinyl chloride or vinylidene chloride in methyl ethyl ketone, tetrahydrofuran or 1,4-dioxane are used and these solutions are introduced, at room temperature, into a fluid precipitation medium under the action of shearing forces, the mean energy density in the fibrid-forming zone of the field of shearing forces being at least 5 Watt. sec/cm$^3$, preferably 20 to 80 Watt. sec/cm$^3$.

It is a further object of the present invention to manufacture high-quality fibrids which have a high degree of fibrillation, a high water absorbency and a high specific surface area, from polymers and copolymers of styrene, vinyl chloride or vinylidene chloride.

We have found that this object is achieved by fibrids of polymers and copolymers of styrene, vinyl chloride or vinylidene chloride, which fibrids have been manufactured by the process of the invention and have a length of from 0.5 to 30 mm, a thickness of from 0.5 to 10$\mu$, a specific surface area of from 10 to 70 m$^2$/g and a Schopper-Riegler freeness of from 15° to 50° SR.

For the purpose of the invention, fibrids are fibrous, synthetic polymer particles which morphologically, in respect of size and shape, and in their properties, resemble cellulose fibers.

Introducing the solution of a polymer into a fluid precipitation medium means mixing the solution with a large excess of the precipitation medium at room temperature. The polymers, dissolved in a solvent at room temperature, should be insoluble in the precipitation medium, whereas the solvent employed should, if possible, be miscible in all proportions with the precipitation medium.

Tetrahydrofuran, methyl ethyl ketone and 1,4-dioxane have proved suitable solvents, tetrahydrofuran being preferred. These solvents, as against less suitable solvents, have a high solvent power, at room temperature, for the polymers in question, are readily miscible with water and have a low boiling point. They form an azeotrope, containing a high proportion of organic solvent, with water; this fact is important for economical recovery of the solvents. For the manufacture of fibrids from the polymer solutions in accordance with the invention, the concentration of the polymers in the solution can be from 0.5 to 30 percent by weight, preferably from 10 to 25 percent by weight.

Water has proved a particularly suitable fluid precipitation medium. However, the process can also be carried out with other precipitation media, e.g. ethylene glycol or alkanols of 1 to 4 carbon atoms. The decisive factor is that the dissolved polymer should be insoluble in the precipitation medium but that the solvent used should be miscible with the precipitation medium.

Polymers which are amorphous or only slightly crystalline may be homopolymers and copolymers of styrene. The copolymers should contain at least 30, and preferably 40, percent by weight of polymerized units. Suitable comonomers in the styrene copolymers are, above all, the esters of acrylic acid with alkanols of 1 to 8 carbon atoms, preferably of 1 to 4 carbon atoms, and also acrylonitrile, maleic anhydride and maleic acid esters. Polymers of vinyl chloride and of vinylidene chloride, copolymers of these monomers, or mixtures, may also be employed for the process according to the invention. The molecular weights of the polymers are in general not a critical factor in the manufacture of the fibrids and lie within the conventional range for the polymers referred to.

The fibrid-forming zone means that zone of an apparatus, which generates a field of shearing forces, in which the polymer solution and the fluid precipitation medium encounter one another and in which a mean energy density of at least 5 Watt. sec/cm$^3$ prevails.

The volume of the zone in which the fibrids are formed depends on the flow rate of the precipitation medium which is being combined with the polymer solution. Since the formation of the fibrids occurs within from $1 \cdot 10^{-2}$ to $1 \cdot 10^{-4}$ second, the length of the fibrid-forming zone is from 0.1 to 50 cm, preferably from 0.1 to 5 cm, at flow rates of from 5 to 50 m/sec.

The shearing force equipment used is of the type which generates a field of shearing forces mechanically by means of rotating elements. For this purpose, commercial machinery which is used for the dispersing and homogenizing of, e.g., polymer dispersions, is suitable. In batchwise operation, high speed dispersing equipment or shearing equipment of the Ultra-Turrax type may be used.

FIG. 1 is a cross-sectional view of an embodiment of apparatus suitable for carrying out the invention.

Figure 2:
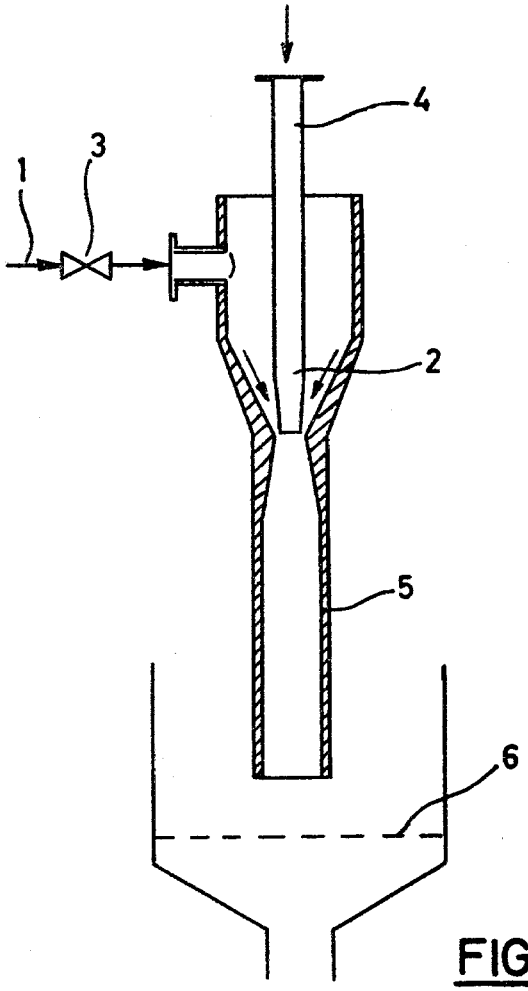
FIG. 2 is a view taken upon line A—B of the apparatus depicted in FIG. 1.

The process can be carried out continuously by the use of the following apparatus (FIG. 1).

A housing (1) having an inlet nozzle (2) and outlet nozzle (3) contains a rotor (4) which is driven by a shaft (5). This rotor (4) causes the fluid precipitation medium, which is present in the housing and is continuously fed in through the inlet nozzle (2), to rotate. The kinetic energy of the rotor is thereby transferred to the fluid precipitation medium. The fluid precipitation medium which has been accelerated is braked in an annular braking zone (6). This braking zone is formed by a ring-shaped stator which posseses sharp-edged orifices and baffles.

To produce the fibrids, the polymer solution is introduced by means of a metering pump through a pipe (7) having an internal diameter of 4 mm into the fluid precipitation medium, the outlet orifice of the pipe being located at the point at which the fluid precipitation medium is at maximum acceleration. A fibrid suspension is continuously discharged from the outlet nozzle (3). The mean energy densities can be from 20 to 80 Watt. sec/cm$^3$.

If the polymer solution is forced through one or more nozzles, and the fluid precipitation medium is at the same time mixed thoroughly, at a flow rate of at least 5 m/sec, with the polymer solution in a field of shearing forces, fibrids are again obtained. The mean energy density in the fibrid-forming zone is from 5 to 30 Watt. sec/cm$^3$.

In a special embodiment, the fluid media are thoroughly mixed in an impulse exchange chamber upstream of, and concentric with, the two-fluid nozzle. The apparatus is described in German Laid-Open Application 2,208,921.

A further embodiment employs the injector principle. The apparatus is shown in more detail in FIG. 2.

In all variants of the process, stable discrete fibrids are obtained directly. They can be separated from the fluid precipitation medium, and from the greater part of the organic solvent, by filtering or centrifuging. The residual solvent is removed by washing with water on the filter or in the centrifuge. The organic solvent employed can be recovered by distillation and be recycled to the process.

The fibrids obtained contain from 80 to 92 percent by weight of water and may be employed, in this form, for wet applications.

For special applications, the fibrids can be dried at elevated temperatures of up to 60° C. A method of drying which employs heating and transport gases which flow at high speed has proved particularly suitable. This method de-felts fibrids which have become felted.

The fibrids manufactured by the process according to the invention have a length of from 0.5 to 30 mm and a thickness of from 0.5 to 10$\mu$. Compared to the staple fibers obtainable from synthetic fibers, the fibrids are distinguished, firstly, in that they have a relatively large specific surface area (from 10 to 70 m$^2$/g) and, on the other hand, by their ability to form a sheet or web when they are deposited on a wire from an aqueous suspension.

Aqueous suspensions of the fibrids manufactured according to the invention are produced, e.g., by introducing the fibrids, whilst stirring, into water which may contain, in solution, from 0.1 to 1.0 percent by weight, based on the dry weight of the fibrids, of a dispersing agent. The fiber pulp obtained is then treated for a further 5 to 15 minutes with a high speed propeller stirrer. The stuff density is in general from 0.5 to 10% and preferably from 1 to 5%.

Examples of dispersing agents which can be used are surface-active compounds made up of hydrophilic and hydrophobic segments, polyvinyl alcohols or starch.

After appropriate further dilution with water, the aqueous suspension of the fibrids can be processed on a paper machine or wet-laid non-woven machine to give papery sheet-like structures. Synthetic fibrids, e.g. of polyethylenes, of the prior art can, in contrast, only be converted to papery sheet-like structures by using the fibrids in admixture with cellulose and employing substantial amounts of dispersing assistants.

However, the fibrids according to the invention also be mixed with cellulose fibers in any desired ratio and the mixture can be processed on a paper machine to give self-supporting, coherent webs.

The degree of fibrillation of the fibrids obtained was ascertained by determining the freeness by the Schopper-Riegler method (Korn-Burgstaller, Handbuch der Werkstoffprufung, 2nd edition, 1953, volume 4, Papier- und Zellstoffprufung, page 388 et seq., Springer-Verlag). For this determination, the fibrids are introduced into an aqueous suspension of constant stock consistency (2 g/l, 20° C.). The amount of water which can be retained by the suspended fibrids under specific conditions is determined. The higher the fibrillation of the fibrids, the greater is the amount of water absorbed (°Schopper-Riegler, °SR). The Schopper-Riegler values for an unbeaten sulfite cellulose are from 12° to 15° SR. By way of example, the Schopper-Riegler values for the fibrids according to the invention are from 15° to 50° SR.

To manufacture coherent, self-supporting webs on a paper machine it is essential that the webs should have a sufficiently high initial web strength. A standard sheet (2.4 g) manufactured from fibrids must have an initial web strength of at least 80 g at a water content of 83 percent by weight. Standard sheets made from the fibrids manufactured according to the invention, on a Rapid-Köthen lab. sheet-forming apparatus, have initial wet strengths of from 100 to 330 g.

The initial wet strengths are determined by means of the test instrument developed by W. Brecht and H. Fiebinger (Karl Frank, Taschenbuch der Papierprufüng, 3rd enlarged edition, Eduard Roether Verlag, Darmstadt, 1958, page 59). Test strips 30×95 mm are produced from the fibrids to be tested on a lab. sheet-forming apparatus, by inserting an appropriate frame. The thickness of the test strips (weight per unit area) is determined by the amount of pulp used. The load in g at which the test strip tears is then measured by means of the test instrument.

The means energy density E in the fibrid-forming zone of the field of shearing forces was calculated as follows:

$$E = \frac{m \cdot v^2}{2} \; [W \cdot \text{sec}]$$

m = mass (kg) of the precipitation medium and of the polymer solution, flowing through the fibrid-forming zone per second.

v = mean flow speed (m/sec) of the combined fluids.

The specific surface area of the fibrids was determined by the BET nitrogen absorption method (S. Brunauer, T. H. Emmett and E. Teller, J. Amer. Chem. Soc., 60 (1938), 309).

The process according to the invention has the particular advantage that discrete, stable fibrids which are virtually free from organic solvents are obtained directly.

A further economic advantage is that sheets of paper and webs, obtained from an aqueous suspension of the fibrids can easily be removed from a wire and have a homogeneous formation and a surprisingly high initial wet strength. These properties make it possible to produce coherent, self-supporting webs consisting to the extent of 100% of fibrids, which have been manufactured from the polymers, on a paper machine. The process according to the invention thus makes it possible also to manufacture high-quality fibrids, which can be processed by the methods used in the papermaking industry, exclusively from polymers, e.g. polystyrene or polyvinyl chloride, which are amorphous or only slightly crystalline.

In the Examples parts and percentages are by weight.

EXAMPLE 1

1,000 parts of a polystyrene which has a density of 1.05 g/cm$^3$ and a melt index of 1.2 g/10 minutes (200° C./5 kp) were dissolved in 9,000 parts of tetrahydrofuran, whilst stirring.

In the apparatus shown in FIG. 1 and described in more detail above, the polymer solution was introduced by means of a metering pump through a pipeline (7) into the precipitation medium, i.e. water, in the immediate vicinity of the rotor (4). At the same time, about a 20-fold volume of water was fed into machine through the inlet nozzle (2). The fibrid suspension discharged from the outlet nozzle (3) was conveyed to a collecting tank. The fibrids accumulated at the surface and were skimmed off. The fibrids thus obtained were drained on a suction filter and washed with water until the residue was free from tetrahydrofuran. The mean energy density in the fibrid-forming zone was 30 Watt. sec/cm$^3$.

The fibrids obtained are very finely fibrillated and have a length of from 2 to 10 mm and a thickness of from 2 to 8$\mu$. The water content of the fibrids was 88.7%.

Measurements of the characteristic properties of the fibrids give:

Specific surface area: 32.1 m$^2$/g
Freeness: 19.8°SR
Initial wet strength of a standard sheet: 230 g To determine the freeness and the initial wet strength, the fibrids were treated with 1%, based on the solids content of the fibrids, of a polyvinyl alcohol which has a degree of saponification of 88 mole percent and a viscosity of 4 cp, measured according to DIN 53,015.

EXAMPLE 2

The procedure described in Example 1 was followed, except that 1,000 parts of a copolymer of styrene and maleic anhydride in a molar ratio of 1:1, which had a density of 1.09 g/cm$^3$ and a melt index of 4.5 g/10 min. (200° C./21.6 kp) were employed.

The fibrids obtained have a finer structure than those obtained in Example 1. They have a length of from 1 to 10 mm and a thickness of from 0.5 to 5$\mu$. The water content of the fibrids was 89.2%.

Measurements of the characteristic properties of the fibrids give:

Specific surface area: 19.7 m$^2$/g
Freeness: 41.5° SR
Initial wet strength of a standard sheet: 207 g A standard sheet of a mixed paper consisting of 70% of the fibrids obtained above and 30% of sulfite cellulose having a freeness of 35°SR had an initial wet strength of 199 g. Dispersing assistants were not used in connection with the above measurements.

EXAMPLE 3

The procedure of Example 1 was followed except that 500 parts of an emulsion polymer of vinyl chloride, having a viscosity index of 160 ml/g (measured according to DIN 53,726) were employed.

The fibrids obtained have a very fine structure, a length of from 3 to 10 mm and thickness of from 1 to 8$\mu$. The water content of the fibrids was 86.2%.

The following properties of the fibrids were measured:

Specific surface area: 12.7 m$^2$/g
Freeness: 20°SR
Initial wet strength of a standard sheet: 180 g

EXAMPLE 4

The procedure of Example 1 was followed except that 500 parts of a suspension polymer of vinyl chloride, having a viscosity index of 92 ml/g (measured according to DIN 53,726) were employed.

The fibrids obtained have a very fine structure, a length of from 2 to 10 mm and thickness of from 0.5 to 8$\mu$. The water content of the fibrids was 84.7%.

Measurements of the properties of the fibrids give:

Specific surface area: 10.2 m$^2$/g
Freeness: 17.9°SR
Initial wet strength of a standard sheet: 214 g A standard sheet of a mixed paper consisting of 70% of the fibrids obtained above and 30% of sulfite cellulose having a freeness of 35°SR had an initial wet strength of 250 g.

EXAMPLE 5 (batchwise method)

10 parts of a polystyrene which has a density of 1.05 g/cm$^3$ and a melt index of 1.2 g/10 min. (200° C./k kp), were dissolved in 90 parts of tetrahydrofuran, whilst stirring.

To manufacture the fibrids, an Ultra-Turrax apparatus, type T 45, with a 400 Watt drive, was used to generate a field of shearing forces. The shearing element of this apparatus is approximately at the center of the 1,000 parts of water introduced into a vessel. The polymer solution was then metered directly into the precipitation medium at the point of maximum suction of the shearing element. The mean energy density in the fibrid-forming zone was 75 Watt. sec/cm$^3$.

The fibrids which accumulated at the surface of the precipitation medium were removed from the vessel and freed from adhering solvent by washing with water on a laboratory suction filter.

The fibrids obtained have a very fine structure, a length of from 0.5 to 5 mm and a thickness of from 2 to 10$\mu$. The water content was 81.4%.

Measurements of the characteristic properties of the fibrids gave:

Freeness: 20° SR
Initial wet strength of a standard sheet: 134 g

COMPARATIVE EXAMPLE

The procedure described in Example 5 was followed, but the apparatus for generating a field of shearing forces was a Waring mixer with a 450 Watt drive and giving a mean energy density of 4.5 Watt. sec/cm$^3$ in the fibrid-forming zone.

The fibrids obtained had a coarse fiber structure. Lengths of from 0.5 to 8 mm and thicknesses of from 4 to 20$\mu$ were measured. In addition, the fibrous product contained some fines. The water content was 72%.

It was not possible to produce a sheet of paper from the fibrids on the sheet-forming apparatus. However, it was possible to produce a mixed paper consisting of 70% of the fibrids obtained above and 30% of sulfite cellulose of freeness 35°SR; this paper had an initial wet strength of 106 g.

The freeness of the fibrids was 10.5°SR.

EXAMPLE 6

The procedure described in Example 5 was followed except that 1,000 parts of ethylene glycol were used instead of water as the precipitation medium.

The fibrids obtained are very finely fibrillated, and have a length of from 0.5 to 5 mm and a thickness of from 1 to 8μ.

Measurements of the fibrid properties gave:

Freeness: 28.5° SR

Initial wet strength of a standard sheet: 163 g.

EXAMPLE 7

500 parts of the styrene copolymer described in Example 2 were dissolved in 9,500 parts of tetrahydrofuran in a stirred vessel. The injector nozzle shown in FIG. 2 is used to manufacture the fibrids. The polymer solution is fed through pipeline (1) to an injector nozzle (2) through which flows a jet of water (4), which is under a pressure of 6 bars. The water leaves the nozzle, which has a diameter of 3.7 mm, at a speed of 25 m/sec. The adjoining mixing tube (5), which is conical in its upper part, has an internal diameter of 12 mm. The polymer solution is metered in through the valve (3) in such a way that 1 liter of solution is thoroughly mixed with 20 liters of water, which acts as the precipitation medium. The fibrids produced are collected by means of a screen (6). The mean energy density in the fibrid-forming zone is 25 Watt. sec/cm$^3$.

The fibrids are drained on a suction filter and washed with water until free from solvent.

The fibrids obtained have a very fine structure, with a length of from 0.5 to 5 mm and a thickness of from 1 to 6μ. The water content was 85.3%.

Sheets of paper can be produced from the fibrids.

Measurements of the fibrid properties gave:

Freeness: 24.5° SR

Initial wet strength of a standard sheet: 167 g.

EXAMPLE 8

The procedure described in Example 2 was followed, but methyl ethyl ketone was used as the solvent for the polymer.

The fibrids obtained have a very fine structure, with a length of from 2 to 15 mm and a thickness of from 0.5 to 8μ.

The water content of the fibrids is 89.0%.

Measurements of the fibrid properties gave:

Freeness: 38.0°SR

Initial wet strength of a standard sheet: 245 g.

EXAMPLE 9

The procedure described in Example 2 was followed, but 1,4-dioxane was used as the solvent for the polymer.

The fibrids obtained have a very fine structure, with a length of from 1 to 5 mm and a thickness of from 2 to 10μ.

The water content of the fibrids is 91.5%.

Measurements of the fibrid properties gave:

Freeness: 32.5° SR

Initial wet strength of a standard sheet: 324 g.

We claim:

1. In the process for the manufacture of fibrids in a single step, which fibrids have a length of from 0.5 to 30 mm, a thickness of from 0.5 to 10μ, a specific surface area of from 10 to 70 m$^2$/g, and a Schopper-Riegler freeness of from 15° to 50°SR, said process comprising introducing a solution of an amorphous or only slightly crystalline polymer or copolymer of one of the monomers styrene, vinyl chloride, or vinylidene chloride at room temperature into a fibrid-forming zone of a fluid precipitation medium under the action of shearing forces in said zone, the concentration of said polymer or copolymer in said solution being in the range of 0.5 to 30% by weight, said shearing forces being generated by forcing a said solution through one or more nozzles at a flow rate of at least five m/sec into said fluid precipitation medium and thereby thoroughly mixing the solution of said polymer or said copolymer with said fluid precipitation medium, and generating by said forcing of said solution into said fluid precipitation medium a mean energy density in the fibrid-forming zone in the range of 5 to 30 watt-sec/cm$^3$, the improvement comprising the use as the solvent for said polymer or copolymer of a compound selected from the group consisting of methyl ethyl ketone, tetrahydrofuran, 1,4-dioxane and the use of water as the fluid precipitation medium.

2. In the process for the manufacture of fibrids in a single step, which fibrids have a length of from 0.5 to 30 mm, a thickness of from 0.5 to 10μ, a specific surface area of from 10 to 70 m$^2$/g and a Schopper-Riegler freeness of from 15° to 50° SR, said process comprising introducing a solution of an amorphous or only slightly crystalline polymer or copolymer of one of the monomers styrene, vinyl chloride, or vinylidene chloride at room temperature into a fibrid-forming zone of a fluid precipitation medium under the action of shearing forces in said zone, the concentration of said polymer or copolymer in said solution being in the range of 0.5 to 30% by weight, said shearing forces being generated mechanically by rotating elements operating to provide a mean energy density in the fibrid-forming zone in the range of 20 to 80 watt-sec/cm$^3$, the improvement comprising the use as the solvent for said polymer or copolymer a compound selected from the group consisting of methyl ethyl ketone, tetrahydrofuran and 1,4-dioxane, and the use of water as the fluid precipitation medium.

3. The process of claim 2, wherein said solution is introduced into said fluid precipitation medium in the immediate vicinity of the shearing forces mechanically generated by said rotating elements.

* * * * *